United States Patent [19]

Weholt

[11] Patent Number: 4,940,360

[45] Date of Patent: Jul. 10, 1990

[54] INSULATED TUNNEL LINER AND REHABILITATION SYSTEM

[76] Inventor: Raymond L. Weholt, 3119 W. Commodore Way, Seattle, Wash. 98199

[21] Appl. No.: 78,453

[22] Filed: Jul. 27, 1987

[51] Int. Cl.[5] ..... E21D 11/00

[52] U.S. Cl. ..... 405/151; 405/150; 405/132; 405/146; 52/809

[58] Field of Search ..... 405/150, 152, 153, 146, 405/132; 52/809

[56] References Cited

U.S. PATENT DOCUMENTS

| | | | |
|---|---|---|---|
| 2,234,782 | 3/1941 | Smith | 405/153 |
| 3,418,812 | 12/1968 | Khan et al. | 405/151 X |
| 3,673,806 | 7/1972 | Hanig et al. | 405/153 |
| 4,075,855 | 2/1978 | Meldner | 405/152 |
| 4,247,221 | 1/1981 | Lewer et al. | 405/150 |
| 4,494,348 | 1/1985 | Kastelic | 52/809 |
| 4,650,369 | 3/1987 | Thomas et al. | 405/150 X |
| 4,695,188 | 9/1987 | Pulkkinen | 405/150 |

*Primary Examiner*—Dennis L. Taylor

[57] ABSTRACT

An insulating and rehabilitation system especially adapted to unlined rock tunnels for

- the prevention of ice buildup on tunnel arches, walls and base structure
- the prevention of future deterioration of tunnel rock structure resulting from freeze-thaw cycle, and
- the stabilization of present tunnel rock structure which has been weakened by prior freeze-thaw cycles.

The system comprises a modular system of sandwich panels with protected metal skins and insulating cores, prefabricated as a complete liner system to conform with tunnel dimensions and clearance requirements.

The insulating liner system is designed to provide

- sandwich panel construction for high section modulus, flexural strength and minimum panel thickness,
- minimization of rock bolt support system,
- discontinuous metal hangars to eliminate thermal transfer,
- modular construction with cam-lock joints to minimize field labor and accommodate construction under live-traffic conditions,
- joint design to accommodate thermal expansion and contraction,
- waterproof construction to preclude freeze-thaw cycle deterioration,
- low thermal conductivity to accommodate extreme lows of temperature,
- noncombustibility, and
- reasonable installed cost.

Under appropriate circumstances where the rock structure of the tunnel has deteriorated to the extent that rehabilitation of the rock face of the tunnel is required, the void between the rockface and the liner is filled with a lightweight, chemically hardening structural material to maintain the present position of key rocks in tunnel arches and walls, and to preclude further deterioration from freeze-thaw cycles.

13 Claims, 5 Drawing Sheets

INSULATED TUNNEL LINER AND REHABILITATION SYSTEM

BACKGROUND OF THE INVENTION

This invention relates to a liner system for unlined rock tunnels especially adapted for rehabilitation of unstable rock structures resulting from prior freeze-thaw cycles, and the elimination of future freezing and ice buildup on interior surfaces. Much of the original construction of railroads and highways throughout the world involved construction of unlined tunnels in those areas where stable rock formations allowed such construction. In the colder climates, the free water flow and seepage from the rock arches and walls have resulted in major maintenance problems ranging from ice buildup in the tunnel to deterioration of the rock formations from repeated cycles of freezing and thawing.

Past attempts to alleviate the problem have included such techniques as construction of concrete liners, drilling and setting of rockbolts, and insulation of the rock face. Concrete liners and rockbolts have proven to be very expensive and extremely difficult to install under live-traffic conditions. Insulating systems have been unsuccessful primarily due to extreme flammability of the insulation and deterioration of the insulation due to water absorption and eventual deterioration from repeated freeze-thaw cycles.

There is no commercially suitable prior art as indicated by the lack of patents issued under this classification.

SUMMARY OF THE INVENTION

The present invention comprises a modular system of sandwich panels with protected metal skins adhered to insulating cores, prefabricated as a complete liner system to conform with tunnel dimensions and clearance requirements.

Under appropriate circumstances where the rock structure of the tunnel has deteriorated to the extent that rehabilitation of the rock face of the tunnel is required, the void between the rockface and the liner is filled with a lightweight, chemically hardening structural material to maintain the present position of key rocks in tunnel arches and walls, and to preclude further deterioration from freeze-thaw cycles.

The individual panels are fabricated with an impermeable high density closure strip on all edges, both to waterproof the panel and to serve as a secure mounting for commercially available camlock fasteners for rapid joining of the panels into a complete system. The panel joint system, which is designed with sufficient tolerance to accommodate panel expansion and contraction, is waterproofed by factory application of foam gasket tape on all edges and field application of a non-hardening construction sealant.

The preferred mounting for the liner system consists of a base, constructed of the same structural material as the aforementioned fill material, and discontinuous metal hangers along the longitudinal tunnel joints which are fastened to a continuous angle, rockbolted to the tunnel crown or wall.

The resulting installation provides for a liner system which maximizes tunnel clearance consistent with adequate section modulus and flexural strength to accommodate the structural fill between the liner and the tunnel face. The completed system is waterproof and, by virtue of the enclosing metal skins, is noncombustible. The low thermal conductivity of the liner system serves to insulate the rock face of the tunnel from freezing, allowing water flow to be redirected to a drainage system at the base of the liner system. Thus, ice buildup in the tunnel is eliminated and further freeze-thaw deterioration of the tunnel rock structure is prevented.

Where employed, the structural fill between the liner and the rock face serves to maintain the present location of key rocks thus stabilizing the tunnel rock structure against future rock fall. The modular construction of the liner system provides for rapid field installation, thus minimizing remote-area labor costs and accommodating live-traffic conditions during construction.

DESCRIPTION OF THE PREFERRED EMBODIMENT

Figure 1:
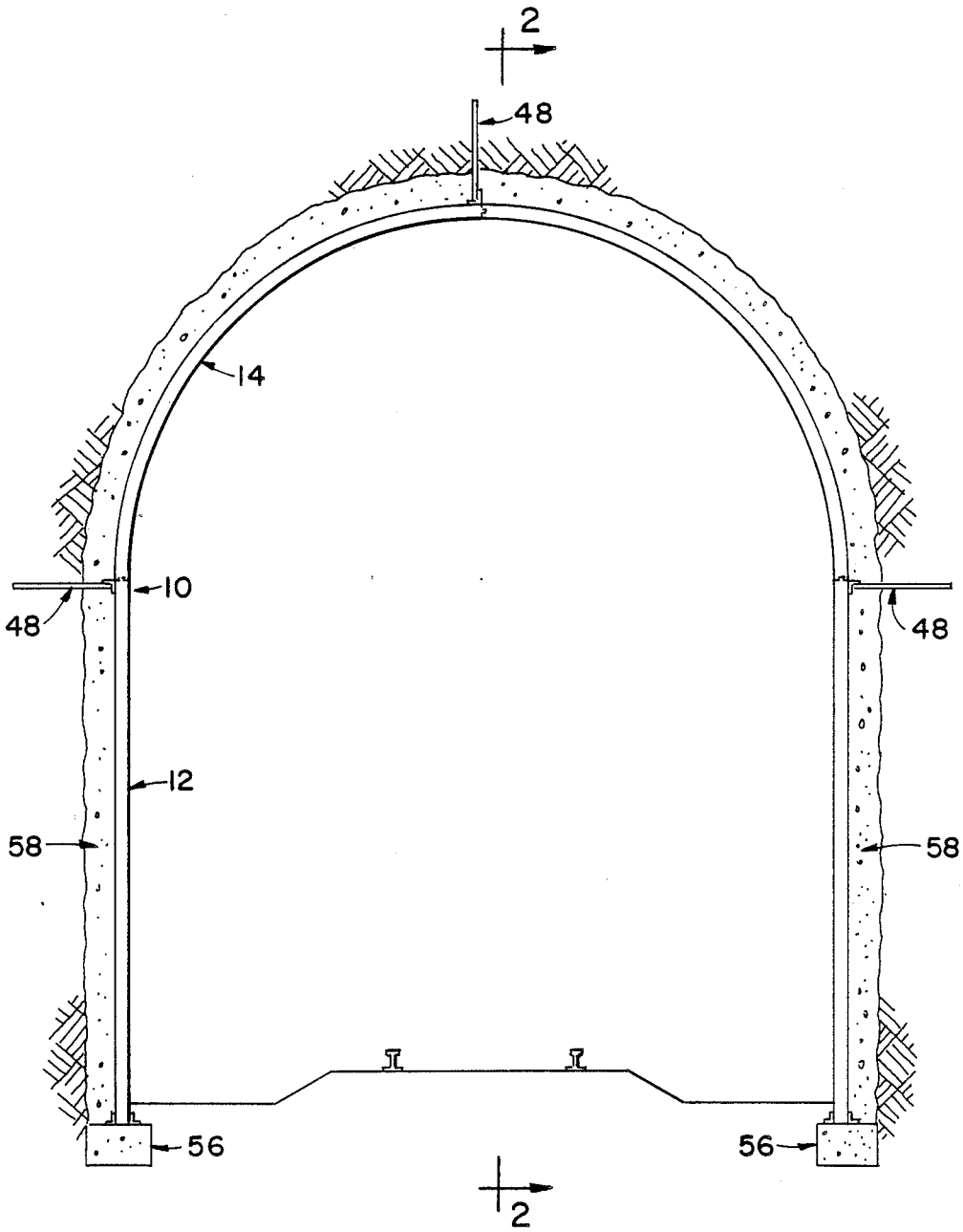
FIG. 1 is a typical transverse sectional view of a tunnel, incorporating the tunnel liner and structural fill of this invention.
Figure 2:
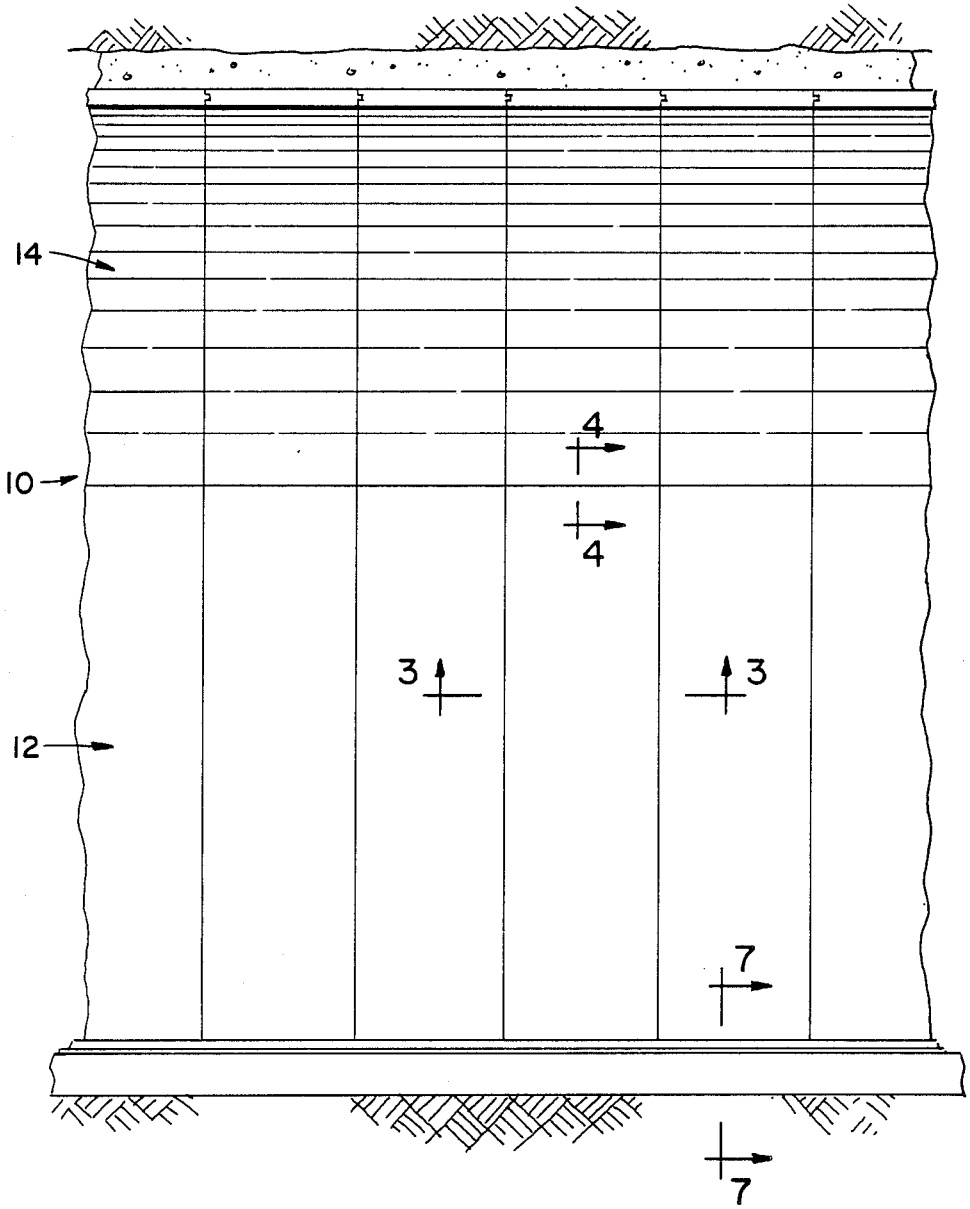
FIG. 2 is a longitudinal elevation view of the liner system taken along line 2—2 of FIG. 1.

The insulating tunnel liner system, generally designated 10 in FIG. 1, comprises a combination of prefabricated modular wall panels 12 and arch panels 14 to conform with tunnel dimensions and clearance requirements. The prefabricated liner panels 12 and 14 are joined in the tunnel, as shown in FIG. 2, to form a continuous insulating barrier between freezing temperatures in the tunnel and the rock face of the tunnel.

Figure 3:
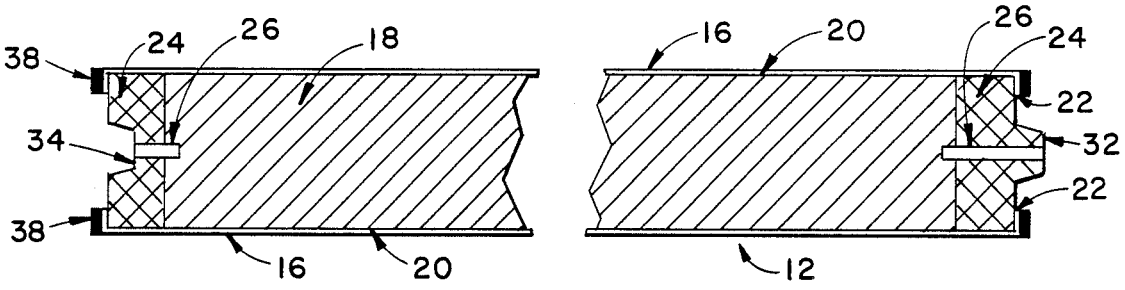
FIG. 3 is a typical section view of a liner panel taken along line 3—3 2.

As shown in FIG. 3, the individual liner panels 12 and 14 are comprised of enclosing metal skins 16 joined to a preformed or foamed-in-place insulating core 18, with a compatible adhesive film 20 of high bond strength. The metal skins 16 are formed to desired panel dimension with a lip 22 at all edges both to strengthen the skin and to provide a secure mounting for the high density strips or mounting blocks 24 for the cam-lock fasteners 26, as will be disclosed more fully hereinafter, which serve to join adjacent panels.

The faces of the metal skins 16 are protected from corrosive elements by one or a combination of methods including selection of appropriate metals, galvanizing, enameling or application of shop or field applied protective coatings.

The insulating core 18 may comprise any of a number of available insulating foams which meet the design criteria for a specific project related to closed cell content, density, compressive, shear, and tensile strength and thermal conductivity. Examples of available foams include polyurethane, polystyrene, and polyethylene. The insulating core 18 may be either preformed to proper dimension or foamed-in-place with commercially available foaming systems. The preformed foam is the preferred method based on improved control of product quality.

Preformed foam is also preferred for fabrication of the arch panels 14 in that the insulating core 18 can be formed with flexible foam sheets, or laminated sheets, thus eliminating the requirement for specially manufactured arch forming presses and special foaming systems.

The panel edge comprises a preformed high density strip 24 which is continuous along all edges of the panel. The high density strip 24 serves as a means of enclosing the panel core to allow a foamed-in-place process, as a secure mounting for the cam-lock fastener 26 and as an impermeable barrier to waterproof the panel.

An alternative to the continuous high density strip 24, available only to the aforementioned preformed foam core process, is the mounting of high density blocks of sufficient dimension to accommodate mounting of the cam-lock fastener 26. In such a process, the preformed insulating core 18 is cut out to accommodate the block mounting, and the exposed foam edge of the insulating core 18 is coated with a compatible waterproofing material.

The tongue 32 and groove 34 configuration of the panel edge 24 serves multiple functions including improved lateral strength of the joint, improved field location and fit of adjoining panels, an additional barrier to water penetration and increased lateral holding strength of the hanger 36, as will be disclosed more fully hereinafter.

Figure 4:
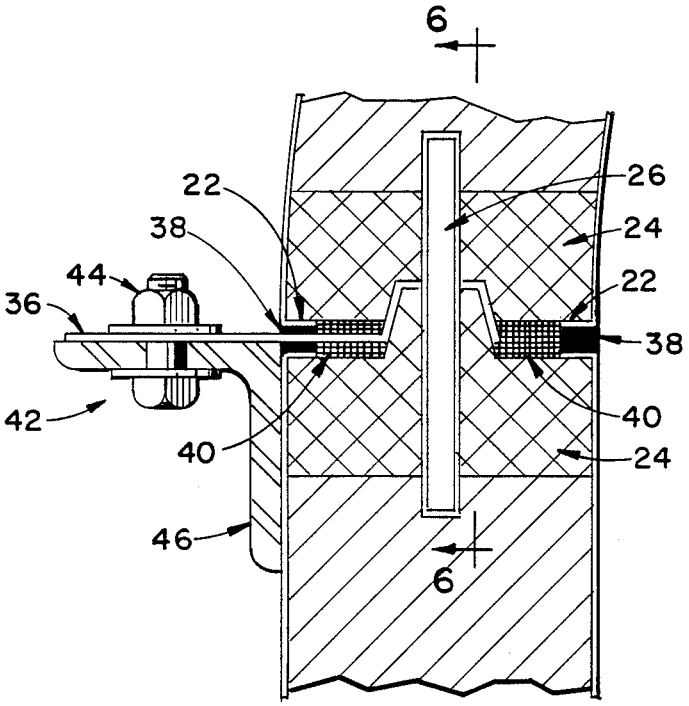
FIG. 4 is sectional view of a typical panel joint taken along line 4—4 of FIG. 2.

Commercially available cam-lock fasteners 26 are mounted on approximately 30 inch centers on all high-density strip 24 panel edges to assure rapid and secure joining of the panels in the field. The male component or arm 30 of the fastener, mounted to the tongue 32 of the high-density strip 24, closing on the female component or pin 28 of the fastener, mounted to the groove 34 of the matching high-density strip 24, forces the tongue 32 and groove 34 edges of adjoining panels together resulting in a joint of high tensile strength and high shear strength by virtue of the tongue and groove configuration of the high-density strip 24 panel edge. As shown in FIG. 4, by virtue of tensile forces translated back to the high-density strip 24 panel edge, the aforementioned closing of the cam-lock fastener also compresses the factory-installed foam gasket tape 38 on the panel lip 22 and the field-installed, continuous bead of construction sealant 40, to serve as additional barriers to water penetration of the joint.

Figure 5:
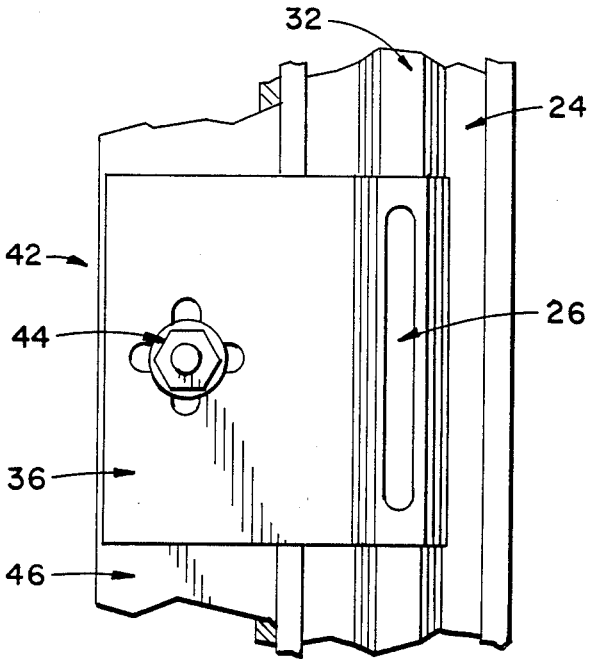
FIG. 5 is a top view of FIG. 4 with the adjoining panel removed.
Figure 6:
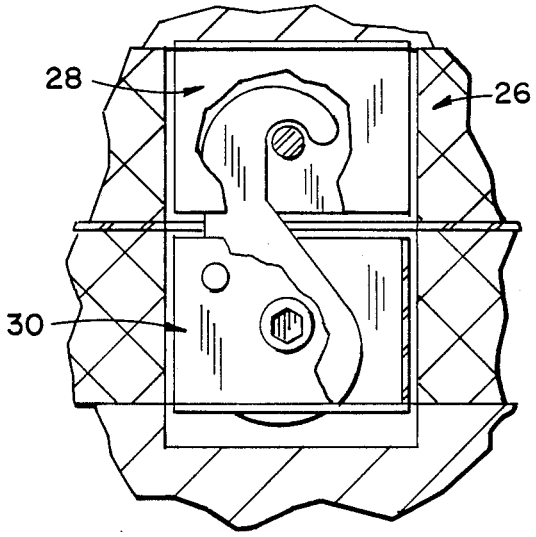
FIG. 6 is an elevation view of a cam-lock fastener taken along line 6—6 of FIG. 4.

The panel mounting system 42, as shown in FIGS. 4 and 5, consists of two fabricated sheet metal hangers 36 per panel, attached by bolt 44, or other mechanical means, to a continuous metal angle 46 which is attached by rock bolt 48, or similar mechanical means, to the tunnel walls along the longitudinal joint line of the insulating panels 12 and 14, as shown in FIG. 1. The hanger is shaped to match the configuration of the tongue 32 and groove 34 joint of adjoining high-density strip 24 panel edges, as a means of withstanding lateral forces on the panel once the aforementioned cam-lock fastener 26 has been closed. Having retained the tongue and groove joint, the hanger 36 is discontinued to minimize transfer of freezing temperature from the inside tunnel face of the panels to the insulated void at the rock-face of the tunnel.

Figure 7:
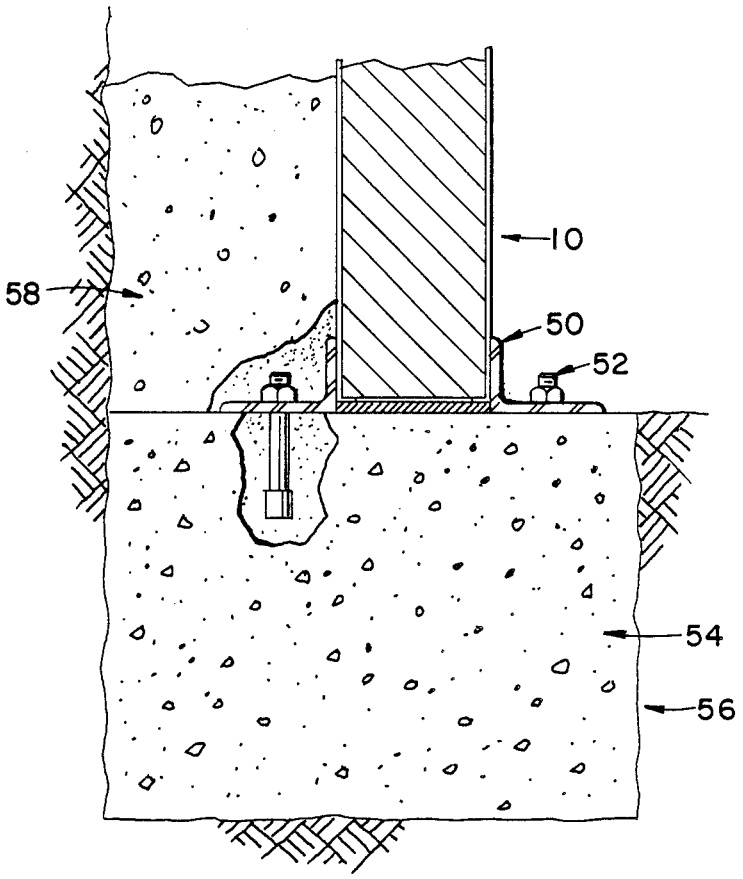
FIG. 7 is a sectional view of the base support taken along line 7—7 of FIG. 2.

The footing 56 for the panel system 10, as shown in FIG. 7, consists of a field-formed and poured mixture of portland cement, light-weight insulating aggregate, such as polystyrene beads, and appropriate admixtures, to form a structurally sound, insulating base 54. The panel system is retained laterally by any of a number of methods including a continuous formed depression, cast to accommodate the panel depth, in the panel base 54; a continuous formed tongue 32 cast onto the base 54, and cast-in-place camlock arms 30 to match the adjoining panel cam-lock pins 28; or, as shown in FIG. 7, continuous parallel angles 50 connected mechanically by bolt 52 or other means to the base 54.

Under appropriate circumstances where the rock structure of the tunnel has deteriorated to the extent that rehabilitation of the rock face of the tunnel is required, the void between the rockface and the liner is filled with a lightweight, chemically hardening structural fill 58, as shown in FIGS. 1 and 7, to maintain the present position of key rocks in tunnel arches and walls, and to preclude further deterioration from freeze-thaw cycles. The structural fill 58 comprises a mixture of polystyrene beads, as aggregate; a wetting agent for said polystyrene beads, to facilitate bonding and preclude segregation of the mix; organic fibers for tensile reinforcement, where required; portland cement, as the bonding agent; sand, if required for added compressive strength; water, as a mixing agent; and admixtures, as required to control physical characteristics of the mix, such as setting time. Prior to placement of the structural fill 58, the rock face of the tunnel is coated with a release agent such that shrinkage of said fill, upon hardening, will provide free passage of seepage water to the base of the liner and rehabilitation system.

What is claimed is:

1. An insulating and rehabilitation system especially adapted to unlined rock tunnels, said system comprising:

(a) a modular system of sandwich panels with protected metal skins adhered to insulating cores, prefabricated and joined as a complete liner system to conform with tunnel dimensions and clearance requirements, (b) a footing for said liner system arranged to provide continuous support and alignment for the system and insulate against thermal transfer to the tunnel wall, and (c) a system of filling the void between said liner system and the rock face of said tunnel with a lightweight, chemically hardening structural material to maintain the present position of unstable, key rocks in said tunnel arches and walls.

2. A system of claim 1, wherein said sandwich panels are prefabricated with protected, spaced and parallel metal skins adhered by adhesive films to a preformed or foamed-in-place insulating core and pressed to assume either a curved panel to match the arch radius of the tunnel or a straight panel to match the vertical wall of the rock tunnel face.

3. A system of claim 2, wherein said sandwich panel includes enclosing panel edges comprising inwardly formed lips on the metal skins secured to rigid, high-density edge strips which form either a continuous frame at the panel edge or appropriately spaced discontinuous mounting blocks.

4. A system of claim 3, wherein said panel edges contain appropriately spaced cam-lock fasteners mounted to said continuous high-density edge strip or said discontinuous mounting blocks.

5. A system of claim 3, wherein said high-density edge strips are configured to form a matching tongue and groove joint for adjoining panels.

6. A system of claim 3, wherein said inwardly formed metal lips are equipped with a continuous water resistant foam gasket tape which when compressed by said cam-lock fastener will render the panel joint waterproof.

7. A system of claim 1, wherein said liner system is mounted to the tunnel structure by means of metal hangers, formed to match said tongue and groove panel joint configuration, and attached by bolt or other mechanical means to continuous metal angles rock-bolted to the tunnel face along the longitudinal joint lines of said liner system.

8. A system of claim 1, wherein said liner system is further waterproofed by application of non-hardening construction sealant to the panel edges at all joints of said liner system.

9. A system of claim 1, wherein said footing for said liner system is field-formed and poured with a mixture of portland cement, lightweight insulating aggregate and appropriate admixtures to provide support and alignment of said liner system and to minimize thermal transfer through said footing.

10. A system of claim 9, wherein said footing is provided with a cast-in-place or a mechanical means of restraining the base of said liner system against lateral forces.

11. A system of claim 1, wherein the void between said liner system and the rock face of the tunnel is filled, by pumping or manual means, with a lightweight, chemically hardening structural fill to rehabilitate presently unstable rock structure by maintaining the present position of key rocks in the tunnel arches and walls.

12. A system of claim 11, wherein said structural fill comprises a mixture of polystyrene beads, as aggregate; a wetting agent for said polystyrene beads, to facilitate bonding and preclude segregation of the mix; organic fibers for tensile reinforcement, where required; portland cement, as the bonding agent; sand, if required for added compressive strength; water, as a mixing agent; and admixtures, as required to control physical characteristics of the mix, such as setting time.

13. A system of claim 11, wherein the rock face of the tunnel is coated with a release agent prior to filling said void such that shrinkage of filler material, upon hardening, will provide free passage of seepage water to the base.

* * * * *